US006877955B2

(12) United States Patent
Higashimori et al.

(10) Patent No.: US 6,877,955 B2
(45) Date of Patent: Apr. 12, 2005

(54) MIXED FLOW TURBINE AND MIXED FLOW TURBINE ROTOR BLADE

(75) Inventors: Hirotaka Higashimori, Nagasaki-ken (JP); Takao Yokoyama, Nagasaki-ken (JP); Takashi Mikogami, Kanagawa-ken (JP); Shiro Yoshida, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/647,340

(22) Filed: Aug. 26, 2003

(65) Prior Publication Data

US 2004/0105756 A1 Jun. 3, 2004

(30) Foreign Application Priority Data

Aug. 30, 2002 (JP) ..... 2002-253851

(51) Int. Cl.[7] ..... F01O 5/14

(52) U.S. Cl. ..... 416/185; 416/188; 416/223 A; 416/223 B; 416/228; 415/186; 415/208.3; 415/208.5

(58) Field of Search ..... 415/159–165, 415/186, 208.3, 208.4, 208.5; 416/185, 186 R, 183, 188, 223 A, 223 B, 228

(56) References Cited

U.S. PATENT DOCUMENTS 1,987,082 A * 1/1935 Sharp ..... 415/164
3,236,500 A * 2/1966 Kofink ..... 415/165

FOREIGN PATENT DOCUMENTS

SU 373438 A * 7/1973 ..... 416/185
SU 1178903 A * 9/1985 ..... 416/223 B

* cited by examiner

*Primary Examiner*—Christopher Verdier
(74) *Attorney, Agent, or Firm*—Oblon, Spivak, McClelland, Maier & Neustadt, P.C.

(57) ABSTRACT

A mixed flow turbine includes a hub attached to a rotation axis and a plurality of rotor blades. Each of the plurality of rotor blades is attached to the hub in a radial direction, and the hub is rotated based on fluid supplied to a rotation region of the plurality of rotor blades. Each of the plurality of rotor blades has a curved shape that convexly swells on a supply side of the fluid.

4 Claims, 9 Drawing Sheets

Fig. 4A
PRIOR ART
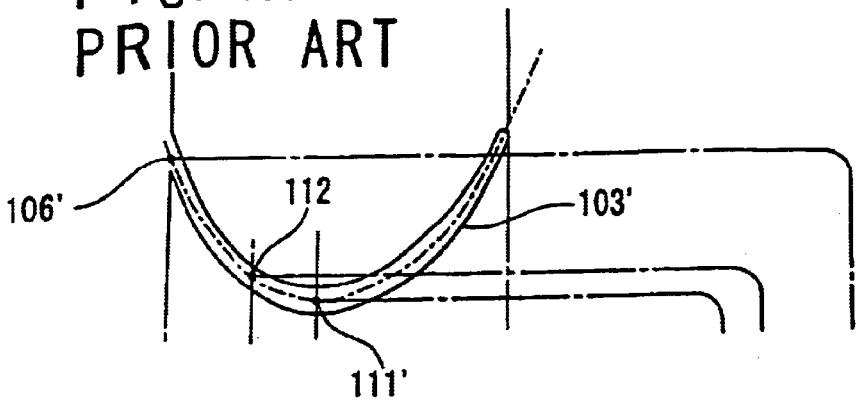
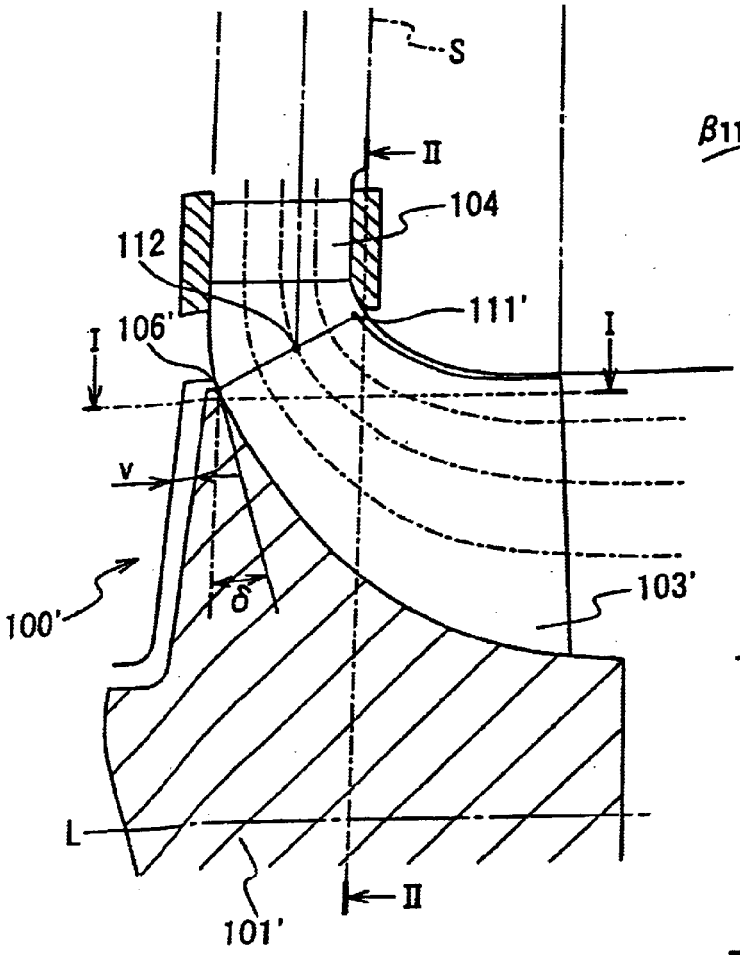
Fig. 4B
PRIOR ART
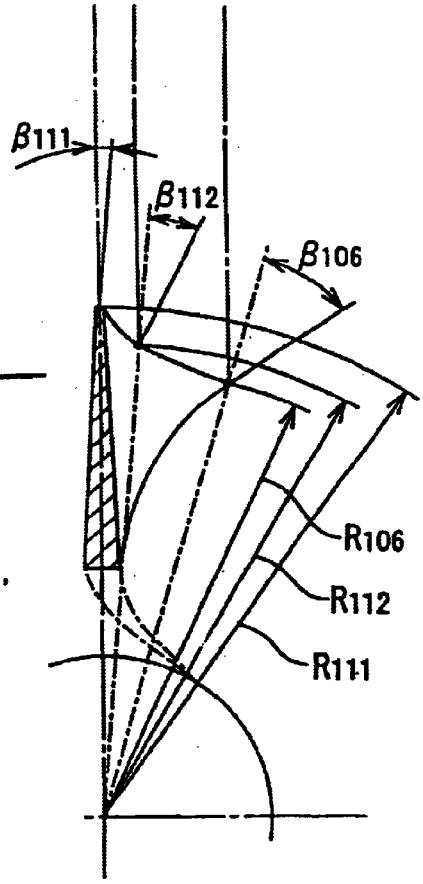
Fig. 4C
PRIOR ART Fig. 7A
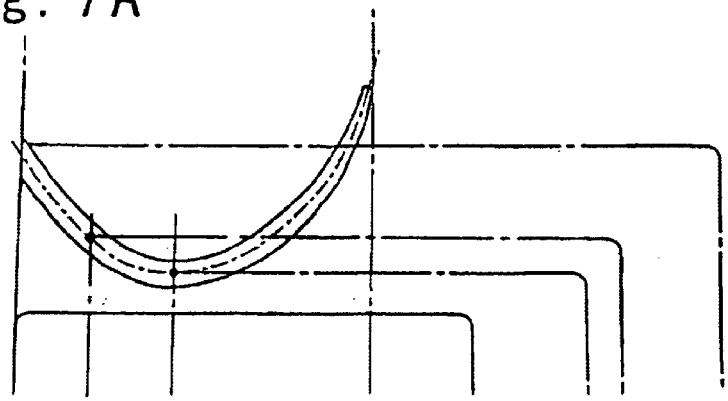
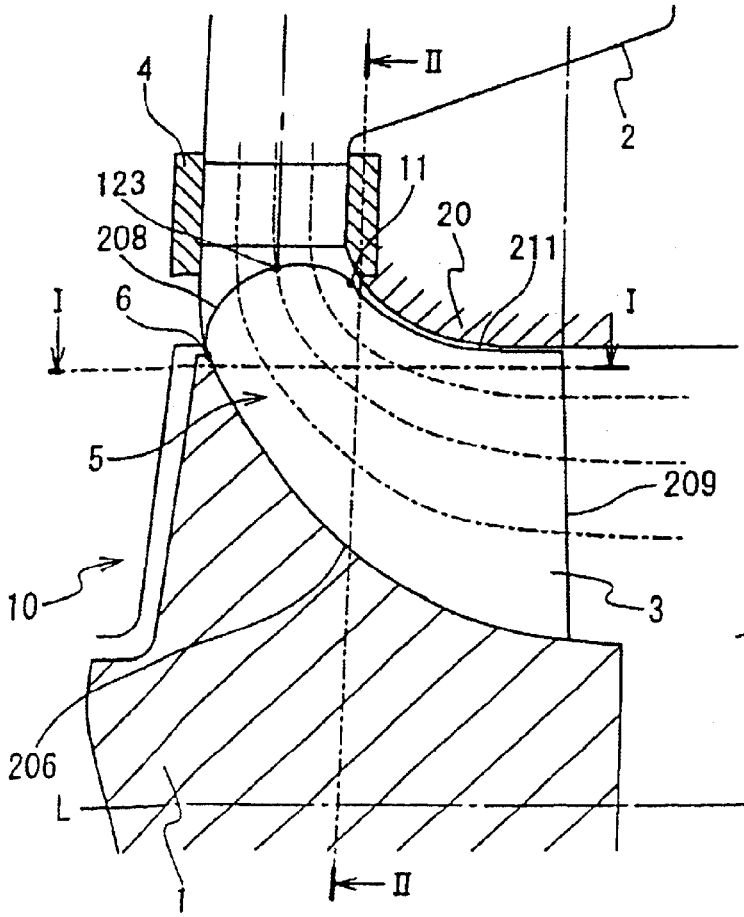
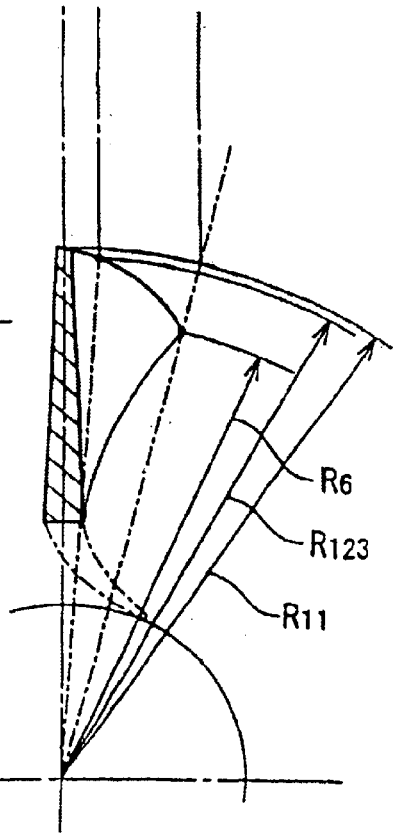
Fig. 7B
Fig. 7C

MIXED FLOW TURBINE AND MIXED FLOW TURBINE ROTOR BLADE

BACKGROUND OF THE INVENTION

1. Field of the Invention

The present invention relates to a mixed flow turbine and a mixed flow turbine rotor blade.

2. Description of the Related Art

As a machine which converts combustion gas energy into mechanical rotation energy efficiently, a radial turbine is known. FIG. 1A is a horizontal cross sectional view of a rotor blade 103 of the radial turbine, and FIG. 1B is a vertical cross sectional view of a rotor blade unit 100 of the radial turbine.

As shown in FIG. 1B, the radial turbine is provided with the rotor blade unit 100 attached to a rotation axis and a scroll 102 having a shape similar to a snail. The rotor blade unit 100 has a hub 101 and a plurality of blades 103 arranged on the hub 101 in a radial direction. A nozzle 104 is interposed between the scroll 102 and a rotating region of the blades 103.

A gas flows from the scroll 102 into the nozzle 104, and is accelerated and given rotation force by the nozzle 104 to produce high velocity flow 105, which flows into the direction of the rotor axis. The flow energy of the high velocity flow 105 is converted into the rotation energy by the blades 103 arranged on the hub 101. The blades 103 exhaust the gas 107 having lost the energy into the direction of the rotation axis.

As shown in FIG. 1A, the cross section of the blade 103 has a shape in which the blade 103 extends approximately linearly in the rotation axis direction in the neighborhood of a gas inlet from the surface of the hub, and then bends in a direction orthogonal to the rotation axis. Thus, the blade 103 is formed to be twisted smoothly into a direction orthogonal to the rotation direction from the hub side to the exhaustion side. Also, an upper edge of the blade 103 on the side of the nozzle 104 is flat and parallel to the rotation axis.

FIG. 2 shows a relation between the blade profile of the blade 103 in the view from the rotation axial direction and its inlet velocity triangle of the radial turbine. As shown in FIG. 2, U represents the rotation velocity of the blade 103 in the gas inlet, C represents an absolute flow velocity, and W represents a relative flow velocity W. The turbine efficiency is expressed in relation to a theoretical velocity ratio (=U/C0). Here, C0 shows the maximum flow velocity of the accelerated gas as fluid under the condition of given turbine inlet temperature and given pressure ratio. As shown in FIG. 3, the turbine efficiency $\eta$ is maximized when the theoretical velocity ratio is around 0.7, and decreases parabolically in the region that the theoretical velocity U/C0 is larger than 0.7 and in the region that the theoretical velocity U/C0 is smaller than 0.7. As shown in FIG. 2, the velocity triangle is represented by U, C1 and W1 in the neighboring region of the maximum efficiency point A. The gas which flows into the radial turbine has a relative flow velocity W1 in a direction opposite to the radial direction, i.e., toward the center in the neighboring region A of the maximum efficiency point, and the incidence is approximately zero.

When this kind of turbine is used for a turbo charger, by increasing the fuel supplied to the engine for accelerating, the turbine inlet temperature rises. Also, the absolute flow velocity at the nozzle outlet increases as shown by C2 in FIG. 2, and the relative flow velocity W2 becomes diagonal to the blade 103. As a result, a non-zero incidence i2 is caused. The theoretical velocity C0 rises with the rise of the turbine inlet temperature, and the theoretical velocity ratio U/C0 decreases to the B point. Also, the turbine efficiency $\eta$ decreases from the maximum efficiency point A to a lower efficiency point B with the generation of the incidence i2, as shown in FIG. 3. By increasing the supply of fuel, although one expects the rise of the number of the rotation, the turbine efficiency reduces actually and the acceleration power of the turbine becomes weak and the response ability of the acceleration is deteriorated.

When such a turbine is used as a gas turbine, the high temperature at the turbine inlet causes the increase of C0. In this case, a high temperature resistant material is required for the gas turbine. When the conventional material is used, the limitation of the strength of the material leads the restriction of the rotation velocity U of the blade 103, so that the theoretical velocity ratio U/C0 decreases. As a result, the turbine must be operated in the low efficiency point B.

To conquer such a technical problem, a mixed flow turbine is devised. FIGS. 4A to 4C show a conventional mixed flow turbine. In FIGS. 4A to 4C, the same or similar reference numerals are allocated to the same components as those of FIGS. 1A and 1B.

In the conventional mixed flow turbine, as shown in FIG. 4B, a gas inlet side edge of the blade 103' is linear with a predetermined angle with respect to the direction of rotation. The blade attachment angle $\delta$ between an end point 106' of a blade 103' on the surface of the hub 102 on the gas inlet side and the line of the radial direction is set to a non-zero value, and is often set to 10–40°. In the case of the radial turbine, the blade attachment angle $\delta$ is set to zero. In the mixed flow turbine, the sectional profile of the blade 103' taken out along the line I—I shown in FIG. 4B has a curved (parabolic) shape as a whole, including the neighborhood of the gas inlet, as shown in FIG. 4A.

The flow problem in a typical mixed flow turbine at the point B under the condition that the theoretical velocity ratio U/C0 decreases will be described below. FIG. 5 shows a relation between a blade angle $\beta k$ and a flow angle $\beta$. Referring to FIG. 5, the flow angle $\beta_{107}$ is about 20° and constant at the point B in the radial turbine. The blade angle $\beta_{k108}$ of the radial turbine is zero and constant. In this example, the incidence i2 is about 20° and the efficiency decreases due to this incidence i2, compared with the maximum efficiency. On the other hand, in the mixed flow turbine, the flow angle $\beta_{109}$ is about 20° on the side of the shroud but increases to about 40° on the side of the hub. Such a distribution of the flow angle $\beta_{109}$ is caused by the characteristic of the mixed flow turbine because a rotation radius $R_{106}$ is smaller than a rotation radius $R_{111}$, as shown in FIG. 4C. As shown in FIG. 4C, $R_{106}$ is the rotation radius at the distance between the end point 106' of the blade 103' on the hub side on an inlet side blade edge line and the rotation axis L. Also, the rotation radius $R_{111}$ is the rotation radius at the distance between the end point 111' of the blade 103' on the shroud side on the inlet side blade edge line and the rotation axis L. When the rotation radius $R_{106}$ becomes smaller than the rotation radius $R_{111}$, as shown in FIG. 6, the rotation velocity U decreases. On the other hand, the circumferential component of the absolute flow velocity C increases inversely proportional to the radius by conservation of angular momentum, so that the flow angle $\beta_{109}$ increases to about 40° on the hub side, as shown in FIG. 5. In this way, in the conventional mixed flow turbine, the incidence $I2_{106}$ can be decreased on the side of the hub surface. To measure the increase of the incidence caused by the increase of the flow angle, the blade angle $\beta_{k110}$ in the mixed flow turbine is set to about 40° on the hub side to approximately coincide with the flow angle. At this time, the incidence is shown by $i2_{113}$.

In this way, the mixed flow turbine can be designed for the flow angle $\beta$ and the blade angle $\beta_k$ to be near to each other on the hub side, and the incidence $i2_{106}$ in the hub side can be made to be near to zero. The mixed flow turbine has such advantages. However, the flow angle $\beta_{109}$ decreases linearly from the hub side to the shroud side, the blade angle $\beta_{k110}$ decreases parabolically from the hub side and the shroud side. Therefore, the incidence $i2_{112}$ is increased to a maximum value in a middle point 112 of the gas inlet side blade edge line. The losses in the mixed flow turbine increase due to the difference between the distribution of the flow angle and the distribution of the blade angle and the efficiency of the mixed flow turbine is reduced due to the increase of the incidence.

Therefore, a technique to increase the efficiency of a mixed flow turbine operated at a low theoretical velocity ratio U/C0 is needed.

SUMMARY OF THE INVENTION

Therefore, an object of the present invention is to provide a mixed flow turbine and a mixed flow turbine rotor blade which can be operated at high efficiency at a low theoretical velocity ratio.

In an aspect of the present invention, a mixed flow turbine includes a hub attached to a rotation axis and a plurality of rotor blades. Each of the plurality of rotor blades is attached to the hub in a radial direction, and the hub is rotated based on fluid supplied to a rotation region of the plurality of rotor blades. Each of the plurality of rotor blades has a curved shape that convexly swells on a leading edge. The leading edge is the supply side of the fluid.

In this case, each of the plurality of rotor blades has first to third points in the curved shape on the leading edge. When the first point is a point where the rotor blade is attached to the hub, the third point is a point farther from the first point, and the second point is a middle point between the first and third points, a rotation radius of the second point from the rotation axis may be larger than that of the first point, and a rotation radius of the third point from the rotation axis may be larger than that of the second point.

Also, each of the plurality of rotor blades has first to third points in the curved shape on the leading edge. When the first point is a point where the rotor blade is attached to the hub, the third point is a point farther from the first point, and the second point is a middle point between the first and third points, a rotation radius of the second point from the rotation axis may be larger than that of the first point, and the rotation radius of the second point may be larger than that of the third point from the rotation axis.

Also, it is desirable that a flow angle of the fluid decreases to be convex downwardly from a side of the hub to a side of a shroud.

BRIEF DESCRIPTION OF THE DRAWINGS

FIGS. 4A to 4C are a plane sectional view, a front sectional view, and a side sectional view of a conventional rotor blade, its shape profile and its rotation radius;

FIGS. 7A to 7C are a plane sectional view, a front sectional view and a side sectional view showing a mixed flow turbine according to an embodiment of the present invention;

DESCRIPTION OF THE PREFERRED EMBODIMENTS

Figure 1A:
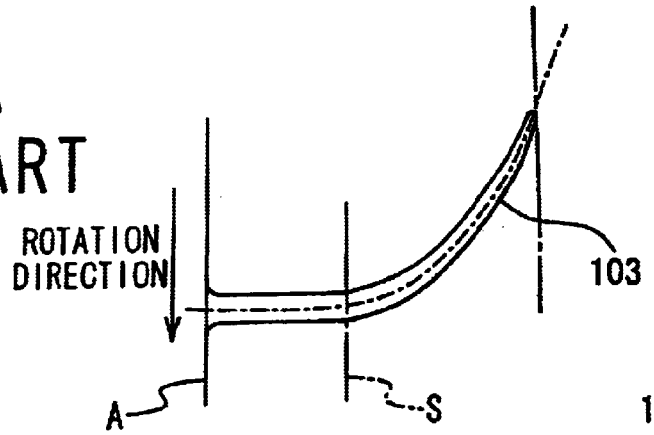
Fig. 1A PRIOR ART
FIGS. 1A and 1B are a plane sectional view and a front section view of a conventional blade and its shape profile.
Figure 1B:
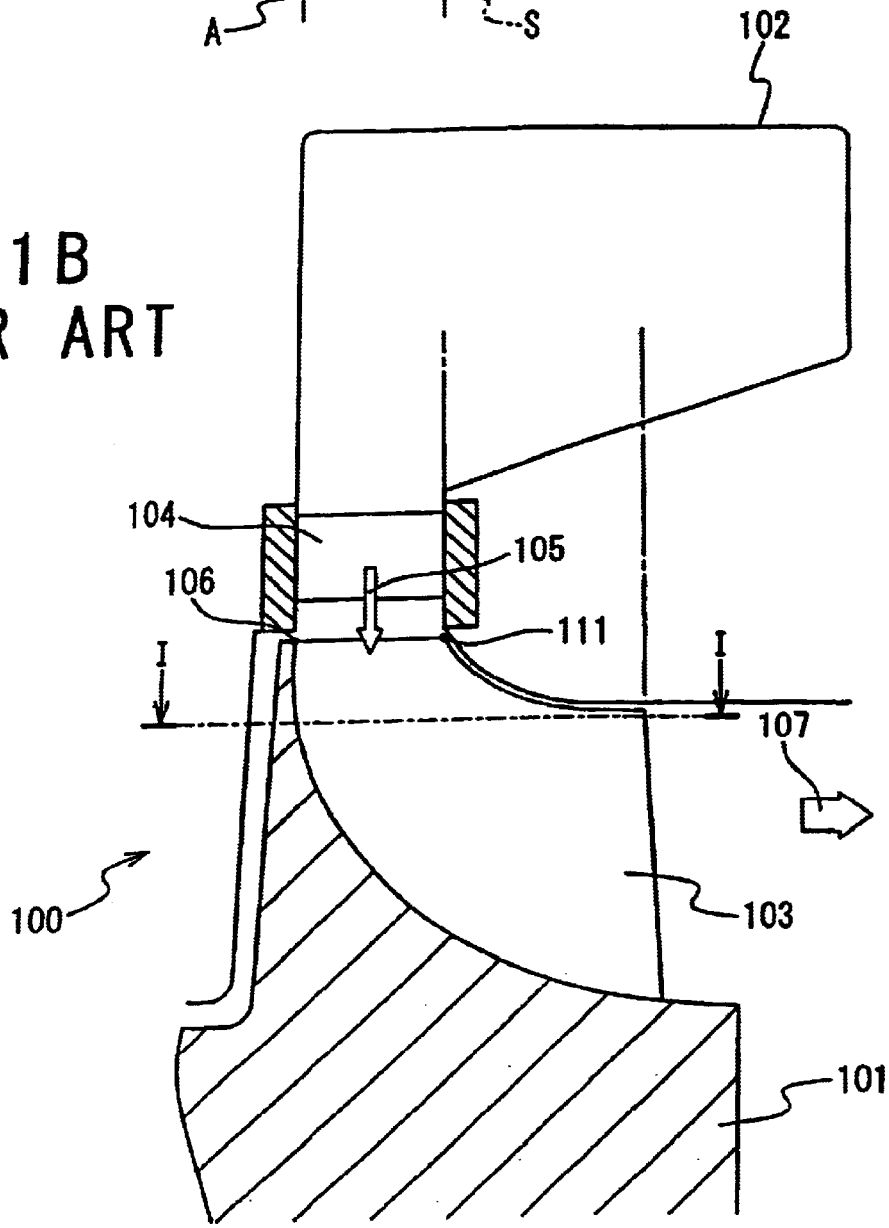
Fig. 1B PRIOR ART

Hereinafter, a mixed flow turbine of the present invention will be described with reference to the attached drawings.

In FIGS. 7A to 7C, the mixed flow turbine according to an embodiment of the present invention is composed of a rotation blade unit 10, a nozzle 4 and a scroll 2.

The scroll 2 is fixed to a fixed shroud 20. A nozzle 4 is interposed between the scroll 2 and the rotation region of the rotor blades 3.

Figure 2:
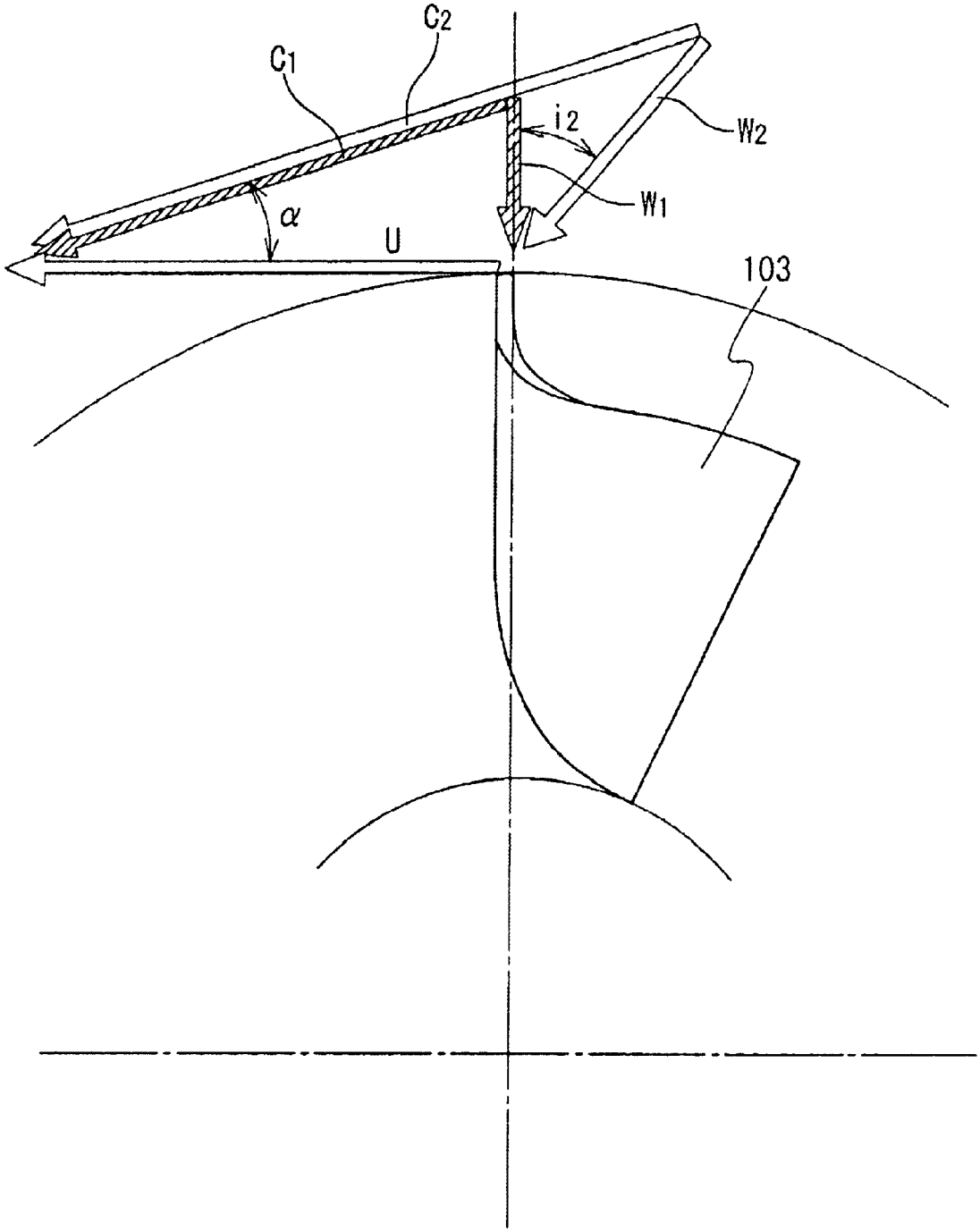
Fig. 2 PRIOR ART
FIG. 2 is a front view showing a velocity triangle.
Figure 3:
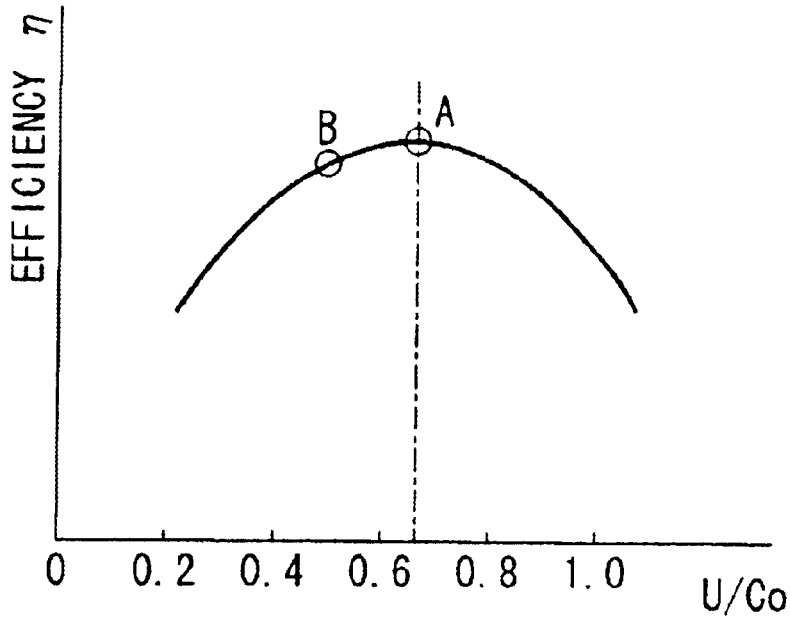
Fig. 3 PRIOR ART
FIG. 3 is a graph showing efficiency in the conventional turbine.

The nozzle 4 gives absolute velocity indicated in the above-mentioned velocity triangle shown in FIG. 2 to the fluid supplied from the scroll 2, and supplies the fluid to the rotation region of the rotor blade 3.

The rotor blade unit 10 includes a plurality of blades 3 which are arranged around and fixed to a hub 1. The rotor blade 3 has an inner side edge 206, an outer side edge 211, a gas inlet side edge 208 and an outlet side edge 209. The inner side edge 206 is fixed to the surface of the hub 1. The outer side edge 211 is rotated around a rotation axis along the inner curved surface of the shroud 20.

As shown in FIG. 7B, the rotor blade 3 has a portion extending in the direction orthogonal to the direction of a rotation axis L and a portion extending in the axial direction from the upstream side to the downstream side along a gas flow path in a plan view. As shown in FIG. 7A, the rotor blade 3 has a shape projecting parabolically in the direction of rotation.

The gas inlet side edge 208 of the blade 3 extending from an end point 6 on the hub side to an end point 11 on the shroud side is formed to have a curve projecting on the upper stream side. The inlet side edge 208 convexly swells in the whole region toward the upper stream side, and a quadratic curve such as a parabola curve is preferably exemplified as a curve of the inlet side edge 208. However, the curve may be cubic, quadratic or higher order curve. The inlet side edge of the rotor blade 103 in the conventional mixed flow turbine is linear.

A rotation radius $R_6$ at the end point 6 on the hub side of the inlet side edge 208 of the blade 3 is RH ($=R_6$), a rotation radius $R_{11}$ at the end point 11 on the shroud side of the inlet side edge 208 of the blade 3 is RS ($=R_{11}$), and a rotation radius $R_{123}$ at a middle point 123 of the inlet side edge 208 of the blade 3 is RM ($=R_{123}$). The rotation radius of the midpoint on the straight line connecting the hub side of the inlet side edge 208 to the shroud side of the inlet side edge 208 is RM*. The end point 11 is situated on the shroud side and has the following relation.

$$RS>RM>RM^*>RH$$

However, the relation may be set as follows:

$$RM>RS>RM^*>RH.$$

Figure 8:
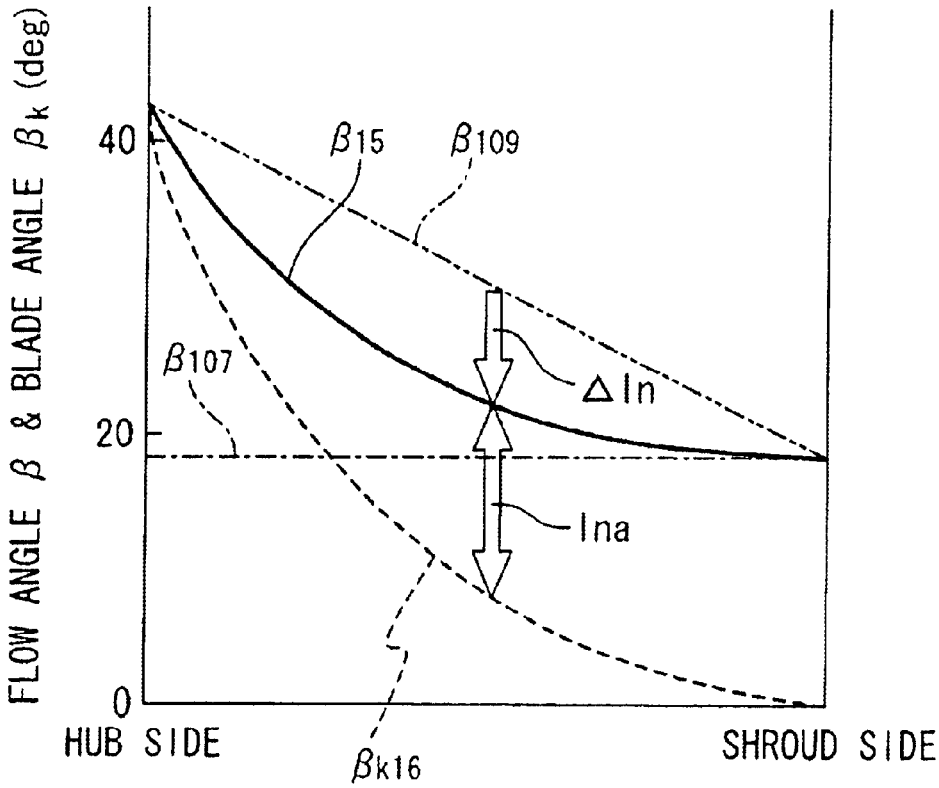
FIG. 8 is a graph showing an incidence distribution in the mixed flow turbine in the embodiment.

In this case, it is possible to increase the incidence difference ΔIn further and to decrease the incidence Ina further, as shown in FIG. 8.

In the mixed flow turbine of the present invention, both the flow angles $\beta_{15}$ on the hub side and the shroud side are approximately equal to the flow angles $\beta_{109}$ in the conventional mixed flow turbine. However, the distribution of the flow angle $\beta_{15}$ in the mixed flow turbine of the present invention monotonously decreases from the hub side to the shroud side and swells convexly in the downward direction. The flow angle $\beta_{15}$ in the mixed flow turbine of the present invention is smaller than the flow angle $\beta_{109}$ in the conventional mixed flow turbine.

Figure 9:
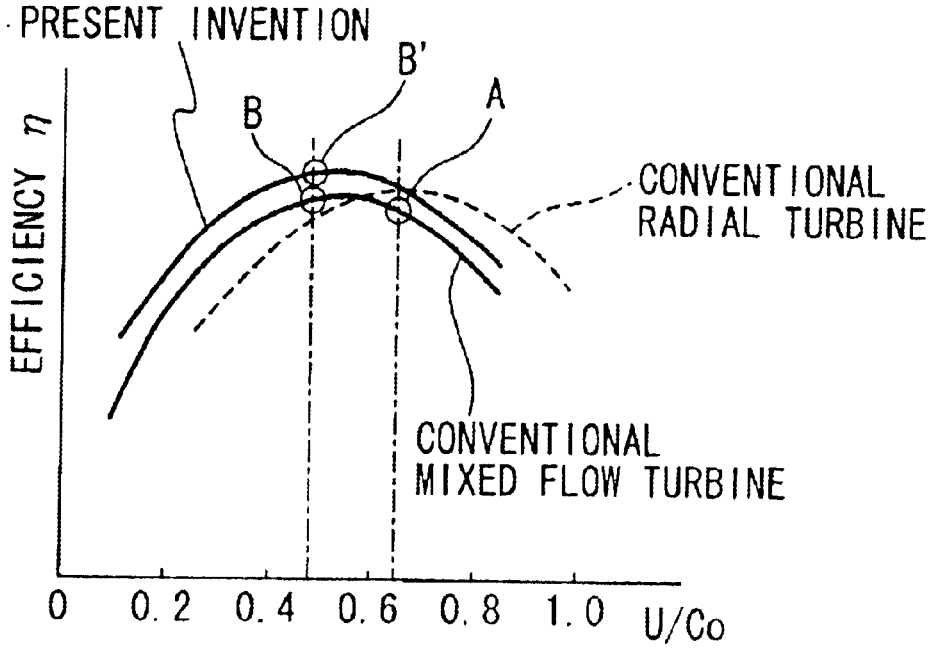
FIG. 9 is a graph showing a turbine efficiency of the mixed flow turbine of the present invention.

Because of the inlet side edge 208 which convexly swells toward the upstream side, as shown in FIG. 9, the following feature is added to the flow angle $\beta_{15}$ at the middle point 123 of the gas inlet side edge 208 when the operation point is the theoretical velocity ratio B point.

Figure 5:
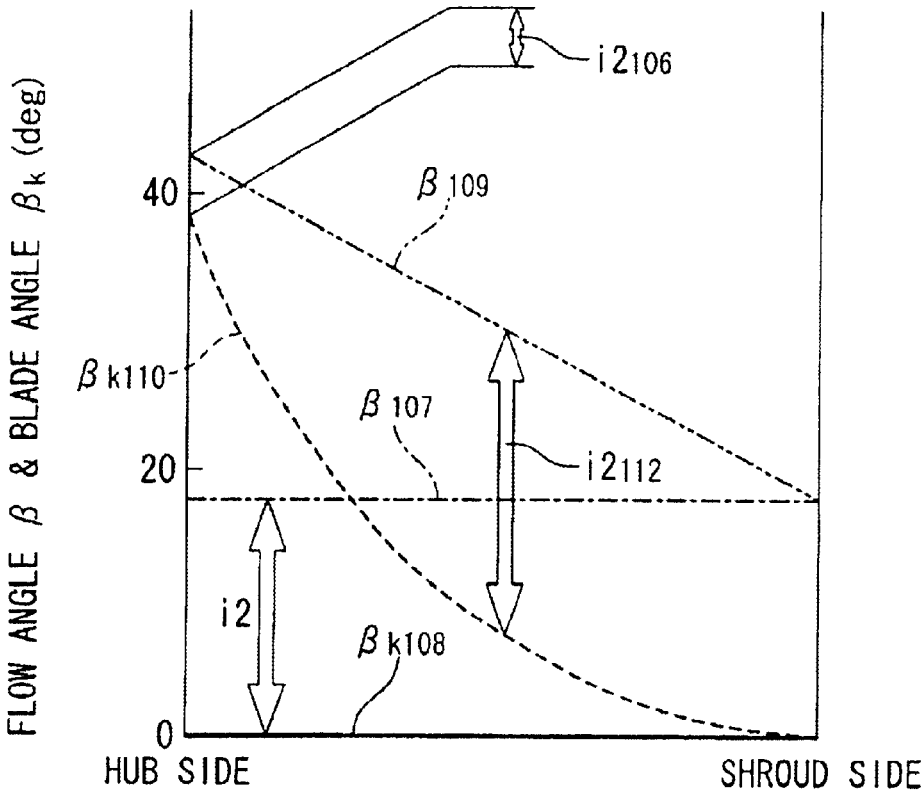
Fig. 5 PRIOR ART
FIG. 5 is a graph showing an incidence distribution in a conventional rotor blade.
Figure 6:
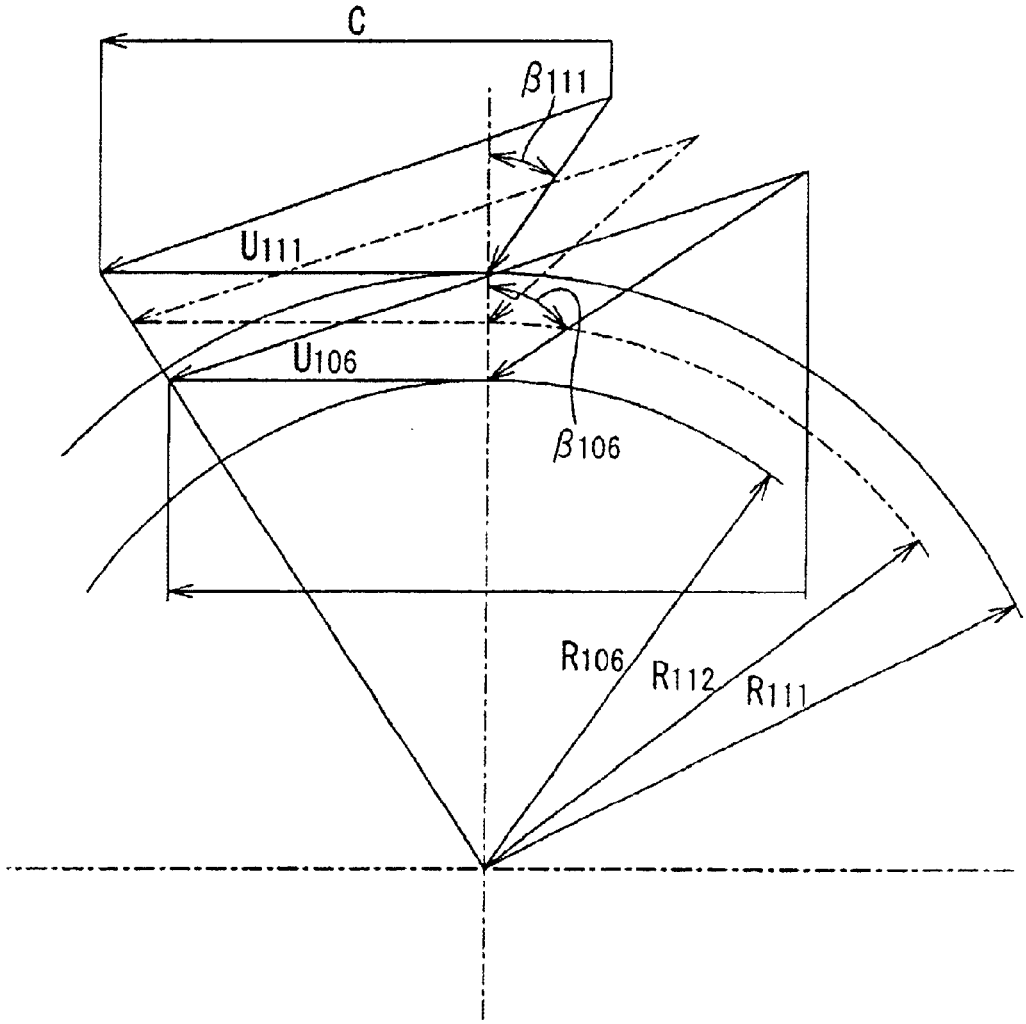
Fig. 6 PRIOR ART
FIG. 6 is a side sectional view showing the rotation radius of each of a conventional rotor blade.

The incidence Ina in the mixed flow turbine of the present invention is smaller than the incidence $In_{112}$ of the conventional mixed flow turbine shown in FIG. 5 as shown in the following equation.

$$Ina = In_{112} - \Delta In$$

Where ΔIn is (the flow angle of the conventional mixed flow turbine)−(the flow angle of the mixed flow turbine of the present invention).

The incidence of the mixed flow turbine of the present invention is further smaller than that of the conventional mixed flow turbine which has been improved compared to the conventional radial turbine. Through such an improvement of the incidence, as shown in FIG. 9, the theoretical velocity ratio U/C0 at the maximum efficiency point of the mixed flow turbine of the present invention is smaller than the theoretical velocity ratio U/C0 at the maximum efficiency point of the conventional mixed flow turbine. As a result, the mixed flow turbine of the present invention can be operated at the higher efficiency point B' at the theoretical velocity ratio point B.

The mixed flow turbine and the mixed flow turbine rotor blade in the present invention make it possible to improve the mixed flow turbine efficiency by reducing the incidence loss.

What is claimed is:

1. A mixed flow turbine comprising:

a hub attached to a rotation axis; and a plurality of rotor blades each rotor blade being attached to said hub in a radial direction, wherein said hub is rotated based on fluid supplied to a rotation region of said plurality of rotor blades, each of said plurality of rotor blades has a curved shape that convexly swells on a supply side of said fluid, and a flow angle of said fluid decreases to be convex downwardly from a side of said hub to a side of a shroud.

2. The mixed flow turbine according to claim 1, wherein each edge of said plurality of rotor blades has first to third points in the curved shape on the supply side of said fluid, said first point is a point where said rotor blade is attached to said hub, said third point is a point as a farther point from said first point, said second point is a midpoint between said first and third points, the rotation radius of said third point from said rotation axis is larger than that of said second point from said rotation axis, a rotation radius of said second point from said rotation axis is larger than a rotation radius of the midpoint on the straight line connecting said first point to said third point, and the rotation radius of said midpoint from said rotation axis is larger than that of said first point from said rotation axis.

3. A rotor blade arrangement used in a mixed flow turbine comprising:

a plurality of rotor blades, each of which is attached to a hub in a radial direction, wherein said hub is rotated based on fluid supplied to a rotation region of said plurality of rotor blades, each of said plurality of rotor blades has a curved shape that convexly swells on a supply side of said fluid, and a flow angle of said fluid decreases to be convex downwardly from a side of said hub to a side of a shroud.

4. The rotor blade arrangement according to claim 3, wherein each edge of said plurality of rotor blades has first to third points in the curved shape on the supply side of said fluid, said first point is a point where said rotor blade is attached to said hub, said third point is a point which a farther point from said first point, said second point is a midpoint between said first and third points, the rotation radius of said third point from said rotation axis is larger than that of said second point from said rotation axis, a rotation radius of said second point from said rotation axis is larger than a rotation radius of the midpoint on the straight line connecting said first point to said third point, and the rotation radius of said midpoint from said rotation axis is larger than that of said first point from said rotation axis.

* * * * *